US010479590B2

(12) United States Patent
Kneer et al.

(10) Patent No.: US 10,479,590 B2
(45) Date of Patent: Nov. 19, 2019

(54) CONTAINER CLOSURE SYSTEM

(71) Applicant: Gaplast GmbH, Altenau (DE)

(72) Inventors: Stephan Kneer, Farchant (DE); Roland Kneer, Farchant (DE)

(73) Assignee: GAPLAST GMBH, Altenau (DE)

( * ) Notice: Subject to any disclaimer, the term of this patent is extended or adjusted under 35 U.S.C. 154(b) by 113 days.

(21) Appl. No.: 15/668,845

(22) Filed: Aug. 4, 2017

(65) Prior Publication Data

US 2018/0037395 A1 Feb. 8, 2018

(30) Foreign Application Priority Data

Aug. 5, 2016 (DE) ..... 10 2016 009 483

(51) Int. Cl.

| | |
|---|---|
| ***B65D 83/04*** | (2006.01) |
| ***B65D 1/02*** | (2006.01) |
| ***B65D 41/04*** | (2006.01) |
| ***B65D 41/16*** | (2006.01) |
| ***B65D 50/04*** | (2006.01) |
| ***B65D 81/26*** | (2006.01) |
| ***B65D 85/60*** | (2006.01) |

(52) U.S. Cl.

CPC ..... *B65D 83/049* (2013.01); *B65D 1/0246* (2013.01); *B65D 41/0485* (2013.01); *B65D 41/16* (2013.01); *B65D 50/04* (2013.01); *B65D 81/266* (2013.01); *B65D 85/60* (2013.01)

(58) Field of Classification Search

CPC ..... B65D 51/30; B65D 81/26; B65D 81/268; B65D 83/049; B65D 1/0246; B65D 25/10; B65D 41/0485

USPC ..... 206/204; 215/228

See application file for complete search history.

(56) References Cited

U.S. PATENT DOCUMENTS

| | | | | |
|---|---|---|---|---|
| 5,346,105 | A | 9/1994 | Onneweer | |
| 7,011,222 | B2 * | 3/2006 | DeJonge | B65D 25/10 206/540 |
| 7,475,773 | B2 * | 1/2009 | Lancesseur | B65D 51/30 206/204 |
| 7,503,453 | B2 * | 3/2009 | Cronin | B65D 47/243 206/221 |

(Continued)

FOREIGN PATENT DOCUMENTS

| | | |
|---|---|---|
| DE | 102004049349 | 4/2006 |
| EP | 1935796 | 6/2008 |
| WO | 2012057837 | 5/2012 |

OTHER PUBLICATIONS

U.S. Appl. No. 15/668,853 entitled "Stopper for a Container", Inventor: Kneer, Stephan et al., filed Aug. 4, 2017.

(Continued)

*Primary Examiner* — Steven A. Reynolds

(74) *Attorney, Agent, or Firm* — Greer, Burns & Crain, Ltd.

(57) ABSTRACT

The container closure system, having a container for capsules, dragées, tablets, and the like, and a screw-on cap that can be screwed onto the container, is characterized in that a dispensing aid has a blocking element having a suspension device, and in that the suspension device is attached to the inner wall of the container and has holes for capsules, dragées, tablets, and the like, wherein the hole is smaller than the container opening.

6 Claims, 1 Drawing Sheet

(56) References Cited

U.S. PATENT DOCUMENTS

| | | | | |
|---|---|---|---|---|
| 8,695,819 | B1 * | 4/2014 | Anderson | B65D 51/18 206/219 |
| 2004/0256400 | A1 | 12/2004 | DeJonge | |
| 2006/0102649 | A1 | 5/2006 | Garukyan | |
| 2007/0114140 | A1 * | 5/2007 | Portier | B65D 51/30 206/204 |
| 2007/0267304 | A1 | 11/2007 | Portier | |
| 2010/0000960 | A1 * | 1/2010 | Anderson | B65D 51/2807 215/228 |
| 2010/0044252 | A1 * | 2/2010 | Portier | B65D 47/0838 206/204 |
| 2011/0297636 | A1 * | 12/2011 | Rault | B29C 45/14 215/256 |
| 2013/0082022 | A1 * | 4/2013 | Cronin | B65D 51/2864 215/228 |
| 2014/0209488 | A1 * | 7/2014 | Dai | B65D 81/268 206/204 |
| 2014/0339106 | A1 * | 11/2014 | Schanin | B65D 51/30 206/204 |
| 2015/0291338 | A1 * | 10/2015 | Chen | B65D 81/268 206/204 |

OTHER PUBLICATIONS

U.S. Appl. No. 15/668,869 entitled "Container Closure System", Inventor: Kneer, Stephan et al., filed Aug. 4, 2017.
Search Report, German Patent Office, German Application No. 10 2016 009 483.4, dated May 16, 2017.
Search Report, European Patent Office, EP 17 00 1260, dated Nov. 22, 2017.

* cited by examiner

CONTAINER CLOSURE SYSTEM

PRIORITY CLAIM

The subject application claims convention priority to German patent application No. 10 2016 009 483.4 filed Aug. 5, 2016.

FIELD OF THE INVENTION

The subject disclosure relates to container closure systems.

SUMMARY OF THE INVENTION

The invention relates to a container closure system that includes a container for capsules, dragées, tablets, and the like, and a screw-on cap that can be screwed onto the container. The container is preferably shaped like a bottle with a bottle neck, but it may also be shaped like a tube. An outer cap that, when it is not deformed, is seated freely rotatable on the screw-on cap and must be pressed securely against the top of the screw-on cap to unscrew the latter—as is known for child-proof containers of this type—may be snapped onto the screw-on cap.

When a capsule or the like (hereinafter referred to only as "capsule") is to be removed from the previously known containers having a screw-on cap, the opened container is generally tilted downward so that the container opening is at the bottom, and the consequence of this is that a significant number of capsules fall out of the opening. The excess capsules are then manually returned to the container. Capsules may be contaminated if they fall onto the ground.

The underlying object of the invention is to improve a container closure system such that the drawbacks described above are avoided.

This object is inventively attained by a container closure system having a container for capsules, dragées, tablets, and the like, and a screw-on cap that can be screwed onto the container, characterized in that a dispensing aid that has a blocking element having a suspension device, and in that the suspension device is attached to the inner wall of the container and has holes for capsules, dragées, tablets, and the like, wherein each hole is smaller than the container opening. Advantageous embodiments of the invention are described herein below.

The invention provides a dispensing aid that is arranged in the container. The dispensing aid includes a blocking element having a suspension device that is attached to the inner wall of the container, near the container opening, and that has holes for capsules, wherein each hole is smaller than the container opening. The blocking element is embodied such that the capsules do not pass through the blocking element so that the capsules must pass through holes of the suspension device in order to fall out of the container opening. Since each hole of the suspension device is smaller than the container opening, only a small number of capsules can fall out of the container when it is tilted downward, wherein this number may be approximately determined by appropriately selecting the size of the holes. It is preferred that at most only two or three capsules are dispensed from the container when the opened container is tilted.

It is particularly advantageously provided that the suspension device has a ring that is connected to the blocking element by bars whose spacing from one another delimits the holes. The ring is preferably snapped into an annular groove in the inner wall of the container, to which end the ring may have a plurality of radially inward recesses that are preferably spaced evenly from one another and make it possible to press the ring together prior to placing it into the container, whereupon the ring elastically re-expands in the groove.

The blocking element is preferably circular, and specifically is preferably embodied having an outer diameter that may match that of the ring.

The suspension device may comprise the same material as the blocking element and may be embodied integrally therewith, wherein the blocking element with suspension device may be produced cost-effectively in an injection molding process.

If the container is a bottle having a bottle neck, the ring is attached in the bottle neck, wherein the blocking element is retained below the bottle neck. It is very advantageous when the blocking element has an upper closing wall that is embodied vaulted or tapering upward. This has the advantage that when excess capsules are being returned to the bottle, the vaulted or conical upper closing wall guides them back through the holes into the container and they do not remain on the blocking element.

The blocking element may be a vaulted or conical disk, for instance, that is connected at its edge to the ring by bars. The blocking element may also be formed by a different body that does not permit the container contents to pass through it. However, it is particularly advantageous when the blocking element is formed by a desiccant chamber that is connected to the attaching ring using the aforesaid bars. In this case, the desiccant chamber is attached in the bottle neck by the suspension device, while in the previously known screw-on caps the desiccant chambers are generally attached to the bottom of the screw-on cap. Since the desiccant chamber may be attached below the container opening, the container opening may be sealed using a film that is welded or glued to the edge of the container opening and is removed before any container contents are dispensed. The embodiment of the aforesaid dispensing aid as a desiccant chamber is consequently associated with dual advantages.

It is also particularly advantageously provided that the blocking element and the suspension device are produced from a desiccant in the injection molding process, so that it is not necessary to create a chamber and fill it with granulate desiccant. This is also inventive over the prior art.

The ring of the suspension device may also be attached to the container in another manner; for instance, it may be glued in.

If the dispensing aid is attached in a tube-shaped container, the outer diameter of the blocking element is naturally smaller than that of the attaching ring. The blocking element and the desiccant chamber may also be connected to the attaching ring other than by bars; for instance, they may be connected using a perforated wall having holes of a suitable size.

What the present invention achieves is that after the screw-on cap has been removed and the container has been tilted downward so that its top is below its bottom, only a small number of capsules fall out of the container opening, wherein this number may be approximately predetermined by appropriately selecting the size of the holes. The container opening may be sealed using a removable film that is welded or glued to the edge of the container opening, wherein the screw-on cap may be screwed into its final position on the container without damaging the film Additional details of the invention may be found in the following description of a preferred embodiment of the invention and using the drawings.

DETAILED DESCRIPTION OF PREFERRED EMBODIMENTS

Figure 1:
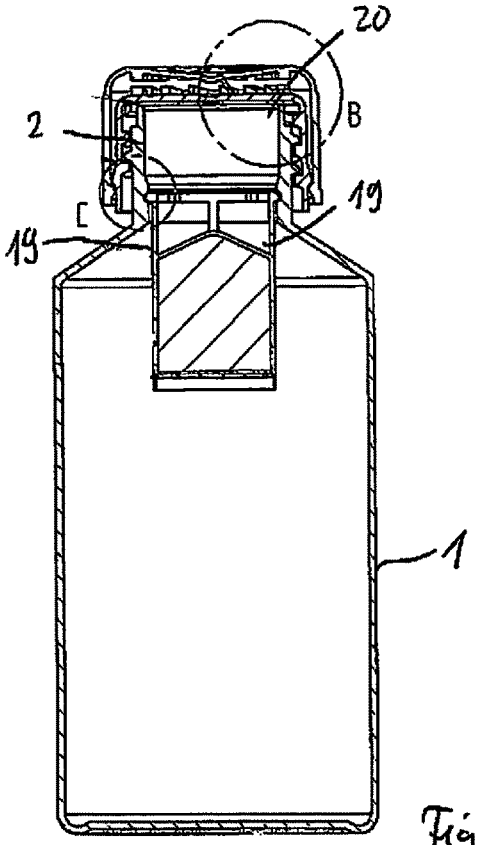
FIG. 1 is a center longitudinal section through a container closure system.
Figure 2:
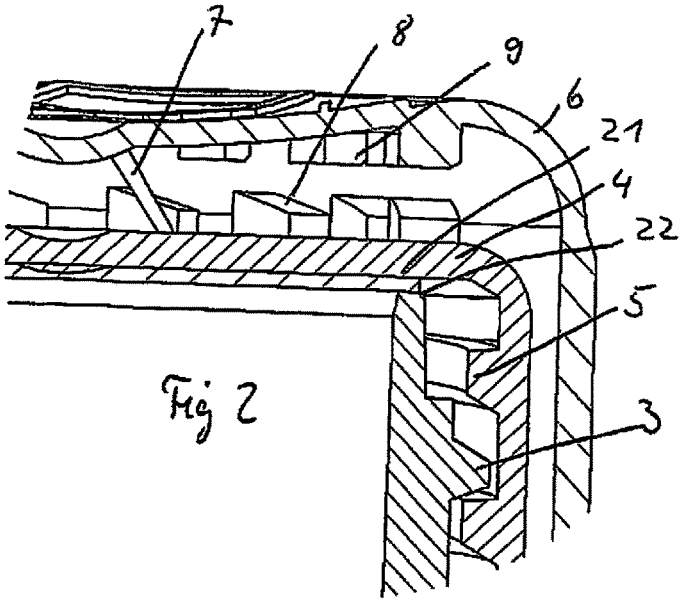
FIG. 2 is an enlarged depiction of detail B in FIG. 1.
Figure 3:
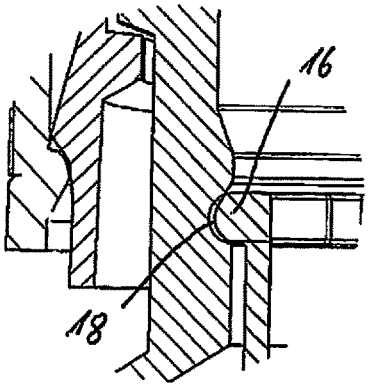
FIG. 3 is an enlarged depiction of detail C in FIG. 1.
Figure 4A:
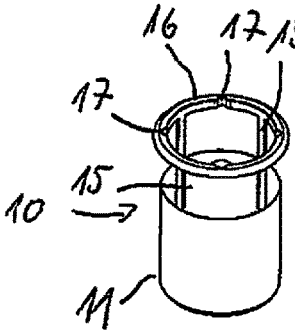
FIGS. 4*a* and 4*b* are a perspective elevation of a dispensing aid and a partially cut-away side view of the dispensing aid.
Figure 4B:
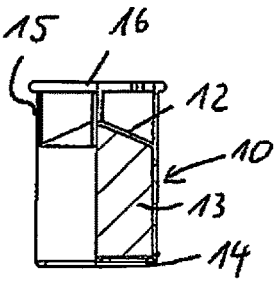

A bottle-shaped container 1 includes a container neck 2 having a male thread 3 onto which is screwed a screw-on cap 4 having a female thread 5. A child-proof cap 6 is snapped onto the screw-on cap 4, and as depicted is seated freely rotatable on the screw-on cap 4. If the child-proof cap 6 is pressed downward against the force of elastic bars 7, teeth 8, 9 on the screw-on cap 4 and on the bottom of the child-proof cap 6 engage in one another so that the screw-on cap 4 may be rotated.

A dispensing aid 10 includes a blocking element 11 that includes an upper conical closing wall 12 and is embodied as a chamber filled with desiccant 13. The lower end of the chamber is sealed by a cardboard disk 14.

The blocking element 11 is connected via four parallel bars 15 to an attaching ring 16, wherein the bars 15 are spaced evenly from one another circumferentially. The ring 16 has four radially inward recesses 17 that are likewise spaced evenly from one another and that permit the ring 16 to be compressed radially.

The ring 16 is snapped into an inner annular groove 18 in the bottle neck 2 and retains the blocking element 11 below the bottle neck. The bottle neck 2 and the bars 15 delimit constricted holes 19 for individual capsules.

Prior to the container closure system being used, the container opening 20 is sealed using an aluminum film 21 that is attached to the upper edge 22 of the container neck 2 using induction welding.

The invention claimed is:

1. A container closure system comprises:

a container for capsules, dragées, and tablets having an inner wall and a container opening, through which capsules, dragrées, and tablets are dispensed out of the container, a screw-on cap that can be screwed onto the container, and a dispensing aid having a blocking element and a suspension device connected to the blocking element, wherein the suspension device is fixedly attached to the inner wall of the container near the container opening and has holes through which capsules, dragées, and tablets must pass before they fall out of the container opening when the container is tilted downwards, wherein each of the holes is smaller than the container opening, wherein the suspension device has a ring which is connected to the blocking element by bars, the spacing of which from one another delimits the holes, wherein the ring is fastened to the inner wall of the container, wherein the blocking element is a desiccant chamber which is filled with desiccant, and wherein the blocking element is configured so that the capsules do not pass through the blocking element, and wherein the container opening is sealed by a removable film that is welded or glued to an edge of the container opening.

2. The container closure system according to claim 1, wherein the ring has a plurality of recesses and is snapped into an annular groove in the inner wall of the container.

3. The container closure system according to claim 1, wherein the suspension device comprises the same material as the blocking element and is embodied integrally therewith.

4. The container closure system according to claim 1, wherein the container has the shape of a bottle having a bottle neck, and the blocking element is retained below the bottle neck.

5. The container closure system according to claim 1, wherein the blocking element has an upper closing wall that is embodied vaulted or tapering upward.

6. The container closure system according to claim 1, wherein the blocking element and the suspension device are made by injection molding a desiccant.

* * * * *